US005124749A

United States Patent [19]

Bares

[11] Patent Number: 5,124,749

[45] Date of Patent: Jun. 23, 1992

[54] DAMPING ELECTRODE WIRES OF A DEVELOPER UNIT

[75] Inventor: Jan Bares, Webster, N.Y.

[73] Assignee: Xerox Corporation, Stamford, Conn.

[21] Appl. No.: 759,362

[22] Filed: Sep. 13, 1991

[51] Int. Cl.[5] ..... G03G 21/00; G03G 15/06

[52] U.S. Cl. ..... 355/202; 355/245; 355/261

[58] Field of Search ..... 355/245, 261, 264, 249, 355/247, 202; 248/55, 901; 174/42

[56] References Cited

U.S. PATENT DOCUMENTS

| | | | |
|---|---|---|---|
| 3,705,445 | 12/1972 | Smollinger | 174/42 |
| 4,868,600 | 9/1989 | Hays et al. | 355/259 |
| 4,890,044 | 12/1989 | Clayburn | 315/411 |
| 4,984,019 | 1/1991 | Folkins | 355/215 |

*Primary Examiner*—A. T. Grimley
*Assistant Examiner*—Nestor R. Ramirez
*Attorney, Agent, or Firm*—H. Fleischer; J. E. Beck; R. Zibelli

[57] ABSTRACT

An apparatus in which a donor roll advances toner to an electrostatic latent image recorded on a photoconductive member. A plurality of electrode wires are positioned in the space between the donor roll and the photoconductive member. The electrode wires are electrically biased to detach the toner from the donor roll so as to form a toner cloud in the space between the electrode wires and photoconductive member. Detached toner from the toner cloud develops the latent image. A damping material is coated on a portion of the electrode wires. The damping material damps vibration of the electrode wires.

14 Claims, 3 Drawing Sheets

DAMPING ELECTRODE WIRES OF A DEVELOPER UNIT

This invention relates generally to an electrophotographic printing machine, and more particularly concerns damping vibration of electrode wires used in a scavengeless developer unit.

Generally, the process of electrophotographic printing includes charging a photoconductive member to a substantially uniform potential so as to sensitize the photoconductive member thereof. The charged portion of the photoconductive photoconductive member is exposed to a light image of an original document being reproduced. This records an electrostatic latent image on the photoconductive photoconductive member. After the electrostatic latent image is recorded on the photoconductive member, the latent image is developed by bringing a developer material into contact therewith. Two component and single component developer materials are commonly used. A typical two component developer material comprises magnetic carrier granules having toner particles adhering triboelectrically thereto. A single component developer material typically comprises toner particles. Toner particles are attracted to the latent image forming a toner powder image on the photoconductive photoconductive member. The toner powder image is subsequently transferred to a copy sheet. Finally, the toner powder image is heated to permanently fuse it to the copy sheet in image configuration.

One type of single component development systems is a scavengeless development that uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development employs a magnetic brush developer roller for transporting carrier having toner adhering triboelectrically thereto. The donor roll and magnetic roller are electrically biased relative to one another. Toner is attracted to the donor roll from the magnetic roll. The electrically biased electrode wires detach the toner from the donor roll forming a toner powder cloud in the development zone, and the latent image attracts the toner particles thereto. In this way, the latent image recorded on the photoconductive member is developed with toner particles. It has been found that unless the toner properties and many other process parameters, such as wire tension, developer roll speed, and AC frequency are within specific latitudes, the electrode wires start to vibrate. Vibration of the electrode wires produces unacceptable print defects, generally referred to as strobing. It is believed that an essentially random combination of electrical and mechanical forces causes the electrode wires to follow the configuration of the developer roll surface until a restoring force due to the wire tension prevails and the wire snaps back. This is analogous to plucking a string which produces sustained vibrations of the electrode wire. Vibrations of this type may be prevented by quickly dissipating the energy imparted to the wire. Various types of development systems have hereinbefore been used as illustrated by the following disclosures, which may be relevant to certain aspects of the present invention:

U.S. Pat. No. 4,868,600, Patentee: Hays et al., Issued: Sep. 19, 1989.

U.S. Pat. No. 4,984,019, Patentee: Folkins, Issued: Jan. 8, 1991.

The relevant portions of the foregoing disclosures may be briefly summarized as follows:

U.S. Pat. No. 4,868,600 describes an apparatus wherein a magnetic roll transports two component developer to a transfer region wherein toner from the magnetic roll is transferred to a donor roll. The donor roll transports toner to a region opposed from a surface on which a latent image is recorded. A pair of electrode wires are positioned in the space between the surface and the donor roll and are electrically biased to detach toner from the donor roll to form a toner cloud. Detached toner from the cloud develops the latent image.

U.S. Pat. No. 4,984,019 discloses a developer unit having a donor roll with electrode wires disposed adjacent thereto in a development zone. A magnetic roller transports developer material to the donor roll. Toner particles are attracted from the magnetic roller to the donor roller. When the developer unit is inactivated, the electrode wires are vibrated to remove contaminants therefrom.

In accordance with one aspect of the present invention, there is provided an apparatus for developing a latent image recorded on a surface, including a housing defining a chamber storing at least a supply of toner therein. A donor member is spaced from the surface and adapted to transport toner to a region opposed from the surface. An electrode member is positioned in the space between the surface and the donor member. The electrode member is closely spaced from the donor member and electrically biased to detach toner therefrom. This forms a toner cloud in the space between the electrode member and the surface with detached toner from the toner cloud developing the latent image. A damping material coats at least a portion of opposed marginal regions of the electrode member. The damping material damps vibration of the electrode member.

Pursuant to another aspect of the present invention, there is provided an electrophotographic printing machine of the type in which an electrostatic latent image recorded on a photoconductive member is developed to form a visible image thereof. The improvement includes a housing defining a chamber storing at least a supply of toner therein. A donor member is spaced from the photoconductive member and adapted to transport toner to a region opposed from the photoconductive member. An electrode member is positioned in the space between the photoconductive member and the donor member. The electrode member is closely spaced from the donor member and electrically biased to detach toner therefrom. This forms a toner cloud in the space between the electrode member and the photoconductive member with detached toner from the toner cloud developing the latent image. A damping material coats at least a portion of opposed marginal regions of the electrode member to damp vibration of the electrode member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
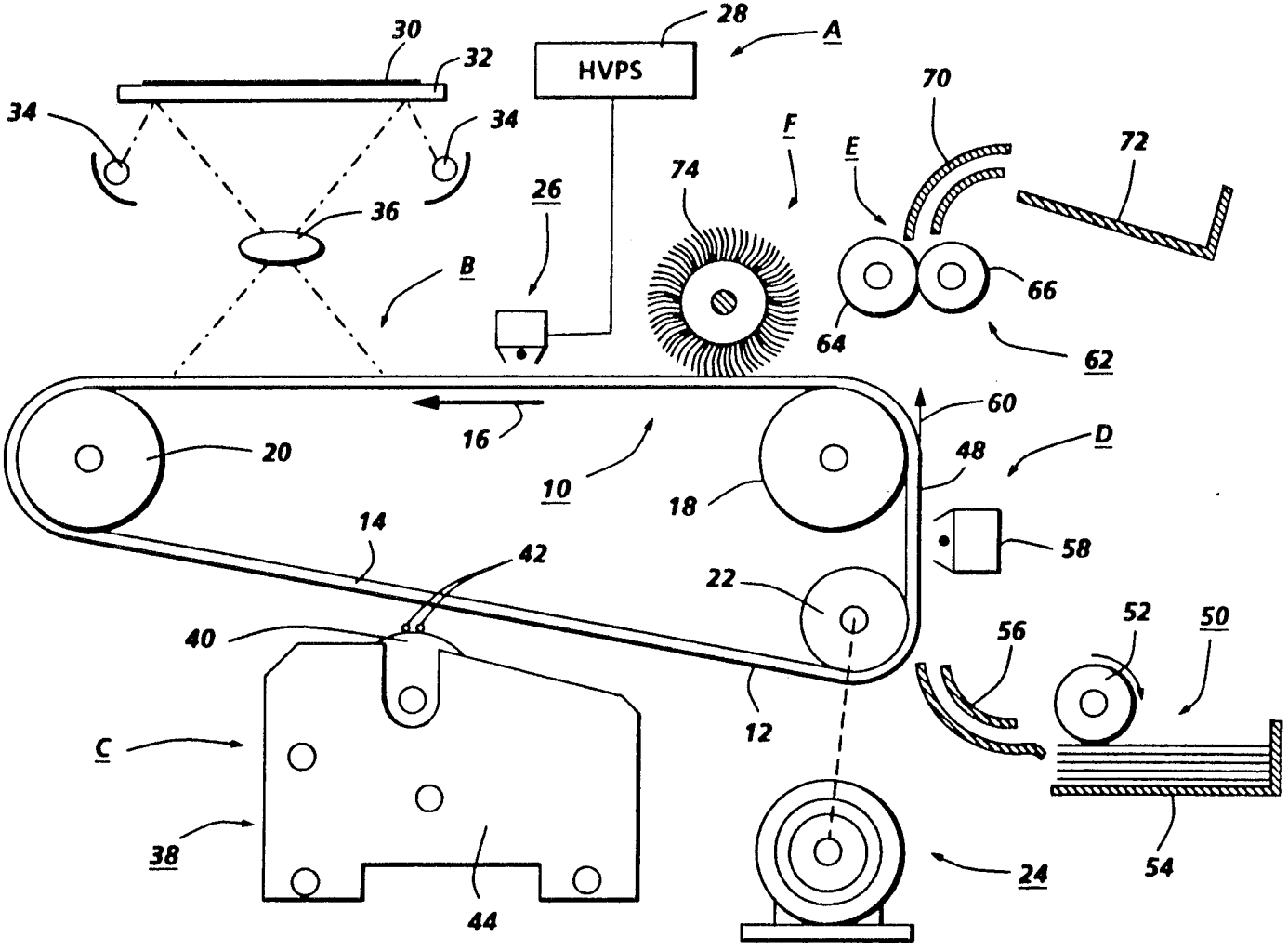
FIG. 1 is a schematic elevational view of an illustrative electrophotographic printing machine incorporating a development apparatus having the features of the present invention therein.

Referring initially to FIG. 1, there is shown an illustrative electrophotographic printing machine incorporating the development apparatus of the present invention therein. The electrophotographic printing machine employs a belt 10 having a photoconductive photoconductive surface 12 deposited on a conductive substrate 14. Preferably, photoconductive photoconductive surface 12 is made from a selenium alloy. Conductive substrate 14 is made preferably from an aluminum alloy which is electrically grounded. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means, such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26. Excitation of power supply 28 causes corona generating device 26 to charge photoconductive member 12 of belt 10. After photoconductive member 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 which corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roller 40 and electrode wires 42. Electrode wires 42 are electrically biased relative to donor roll 40 to detach toner therefrom so as to form a toner powder cloud in the gap between the donor roll and photoconductive surface. The latent image attracts toner particles from the toner powder cloud forming a toner powder image thereon. Donor rollers 40 is mounted, at least partially, in the chamber of developer housing 44. The chamber in developer housing 44 stores a supply of developer material. The developer material is a two component developer material of at least carrier granules having toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. Developer unit 38 will be discussed hereinafter, in greater detail, with reference to FIG. 2.

With continued reference to FIG. 1, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly, indicated generally by the reference numeral 62, which permanently affixes the transferred powder image to sheet 48. Fuser assembly 62 includes a heated fuser roller 64 and a back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 2:
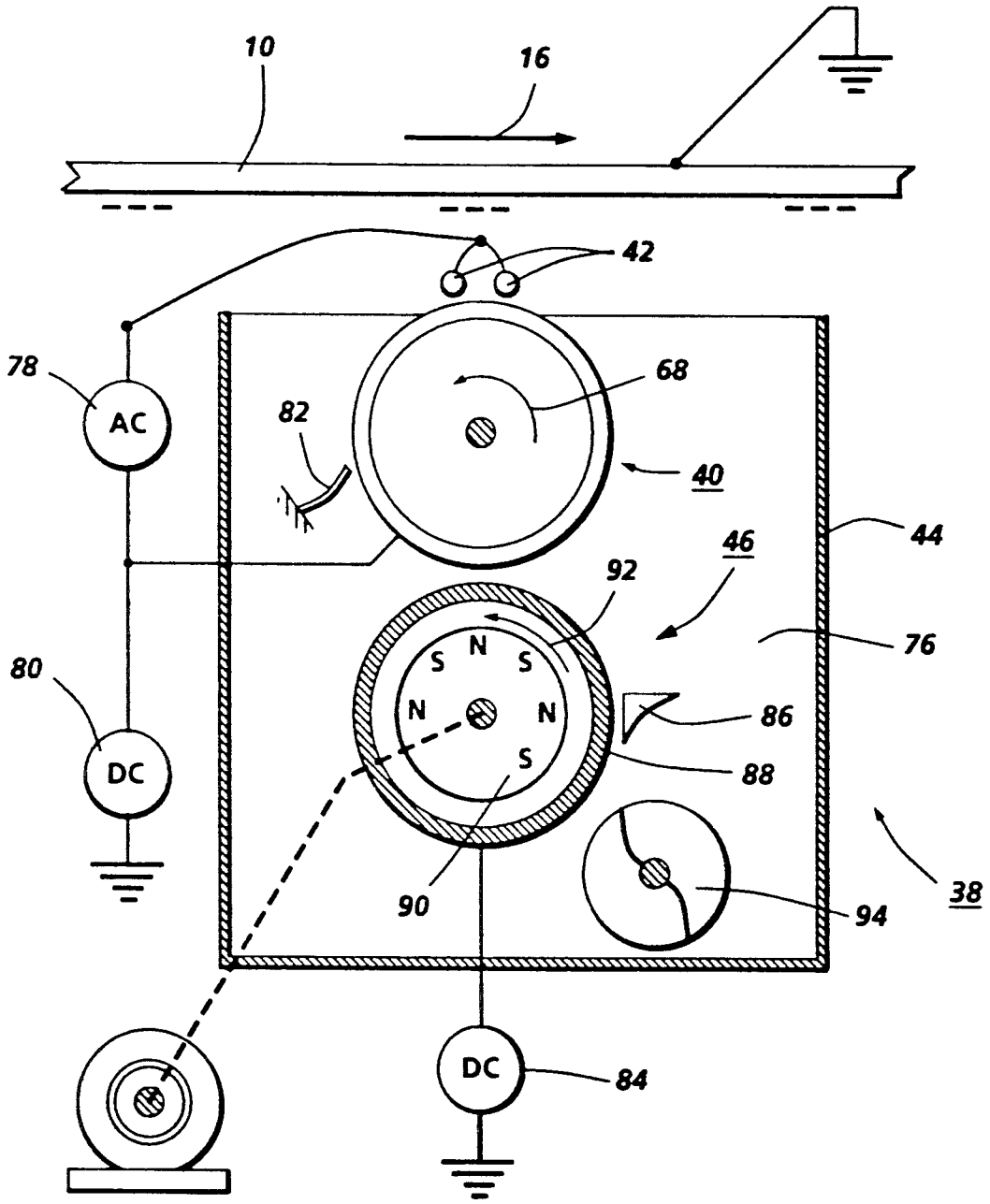
FIG. 2 is a schematic elevational view showing the development apparatus used in the FIG. 1 printing machine.

Referring now to FIG. 2, there is shown developer unit 38 in greater detail. As shown thereat, developer unit 38 includes a housing 44 defining a chamber 76 for storing a supply of developer material therein. Donor roller 40, electrode wires 42 and magnetic roller 46 are mounted in chamber 76 of housing 44. The donor roller can be rotated in either the 'with' or 'against' direction relative to the direction of motion of belt 10. In FIG. 2, donor roller 40 is shown rotating in the direction of arrow 68. Similarly, the magnetic roller can be rotated in either the 'with' or 'against' direction relative to the direction of motion of belt 10. In FIG. 2, magnetic roller 46 is shown rotating in the direction of arrow 92. Donor roller 40 is preferably made from anodized aluminum.

Developer unit 38 also has electrode wires 42 which are disposed in the space between the belt 10 and donor roller 40. A pair of electrode wires are shown extending in a direction substantially parallel to the longitudinal axis of the donor roller. The electrode wires are made from of one or more thin (i.e. 50 to 100μ diameter) stainless steel wires which are closely spaced from donor roller 40. The distance between the wires and the donor roller is approximately 25μ or the thickness of the toner layer on the donor roll. The wires are self-spaced from the donor roller by the thickness of the toner on the donor roller. To this end the extremities of the wires supported by the tops of end bearing blocks also support the donor roller for rotation. The wire extremities are attached so that they are slightly below a tangent to the surface, including toner layer, of the donor structure. Mounting the wires in such a manner makes them insensitive to roll runout due to their self-spacing.

As illustrated in FIG. 2, an alternating electrical bias is applied to the electrode wires by an AC voltage source 78. The applied AC establishes an alternating electrostatic field between the wires and the donor roller which is effective in detaching toner from the photoconductive member of the donor roller and forming a toner cloud about the wires, the height of the cloud being such as not to be substantially in contact with the belt 10. The magnitude of the AC voltage is relatively low and is in the order of 200 to 500 volts peak at a frequency ranging from about 3 kHz to about 10 kHz. A DC bias supply 80 which applies approximately 300 volts to donor roller 40 establishes an electrostatic field between photoconductive member 12 of belt 10 and donor roller 40 for attracting the detached toner particles from the cloud surrounding the wires to the latent image recorded on the photoconductive member. At a spacing ranging from about 10μ to about 40μ between the electrode wires and donor roller, an applied voltage of 200 to 500 volts produces a relatively large electrostatic field without risk of air breakdown. A cleaning blade 82 strips all of the toner from donor roller 40 after development so that magnetic roller 46 meters fresh toner to a clean donor roller. Magnetic roller 46 meters a constant quantity of toner having a substantially constant charge on to donor roller 40. This insures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller in conjunction with the use of a conductive, magnetic developer material achieves the deposition of a constant quantity of toner having a substantially constant charge on the donor roller. A DC bias supply 84 which applies approximately 100 volts to magnetic roller 46 establishes an electrostatic field between magnetic roller 46 and donor roller 40 so that an electrostatic field is established between the donor roller and the magnetic roller which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface thereof roughened. An elongated magnet 90 is positioned interiorly of and spaced from the tubular member. The magnet is mounted stationarily. The tubular member rotates in the direction of arrow 92 to advance the developer material adhering thereto into the nip defined by donor roller 40 and magnetic roller 46. Toner particles are attracted from the carrier granules on the magnetic roller to the donor roller.

With continued reference to FIG. 2, an auger, indicated generally by the reference numeral 94, is located in chamber 76 of housing 44. Auger 94 is mounted rotatably in chamber 76 to mix and transport developer material. The auger has blades extending spirally outwardly from a shaft. The blades are designed to advance the developer material in the axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The auger in the chamber of the housing mix the fresh toner particles with the remaining developer material so that the resultant developer material therein is substantially uniform with the concentration of toner particles being optimized. In this way, a substantially constant amount of toner particles are in the chamber of the developer housing with the toner particles having a constant charge. The developer material in the chamber of the developer housing is magnetic and may be electrically conductive. By way of example, the carrier granules include a ferromagnetic core having a thin layer of magnetite overcoated with a non-continuous layer of resinous material. The toner particles are made from a resinous material, such as a vinyl polymer, mixed with a coloring material, such as chromogen black. The developer material comprise from about 95% to about 99% by weight of carrier and from 5% to about 1% by weight of toner. However, one skilled in the art will recognize that any other suitable developer material may be used.

Figure 3:
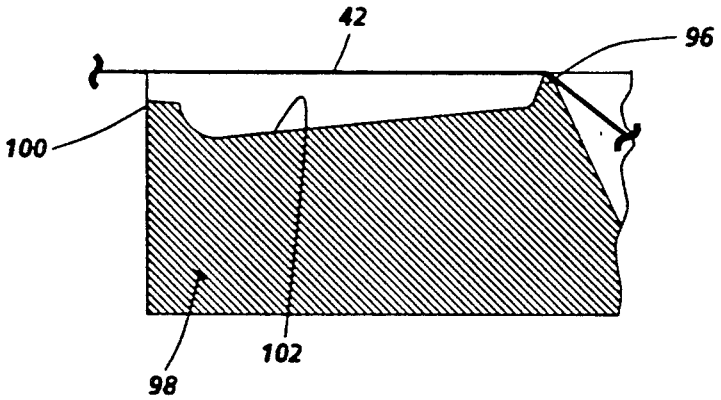
FIG. 3 is a fragmentary, sectional elevational view depicting a portion of the electrode wire mounting arrangement without any damping material coated on the wire.

FIG. 3 depicts the wire mounting arrangement. As shown, electrode wire 42 is rigidly secured to support 98 at wire anchor 96. Wire 42 extends from anchor over donor roller 40. One approach to avoid strobbing is to reduce the distance between anchor 96 and the end of donor roller 40. However, practical design considerations preclude reducing this spacing sufficiently to eliminate strobbing. It is believed that a combination of electrical and mechanical forces cause the wire to follow the donor roll surface until a restoring force due to wire tension snaps the wire back to its initial position. This plucking of the wire produces sustained vibrations of the wire. These vibrations can be prevented if the energy imparted to the wire by plucking is quickly dissipated. Wire vibrations are essentially described by the equation for a damped string. The higher the damping, the better the results. Reducing the length between the end of the donor roller and the wire anchor, reduces the undamped length of the wire. Sudden release of the wire plucked by the donor roll generates a pair of waves traveling in opposite directions along the wire to the wire ends where the waves are reflected back. Damping the wire along the length between the end of the donor roller and the wire anchor attenuates the pair of waves traveling towards the ends after the disturbance, i.e. pluck, and further attenuates the waves reflected from the ends essentially preventing the wire rebound for the next vibration cycle. The space generally available for the damping medium is the distance between anchor 96 and the end of the donor roller less an allowance for the part of the donor roller not covered by toner and a space between the donor roller and the wire support necessary for clearance, location of the donor roller seals, and other functions. The actual length available for damping medium is the distance between anchor 96 and end 100 of support 98. Support 98 forms a platform over this region for the damping material. The damping material is poured in this area to surround the wires and cured in situ. The damping material immediately adjacent to the wire, i.e. the entrained mass, moves or vibrates with the wire. It is well known to those skilled in the art that the wave and its energy propagating along the wire are reflected from any point of the wire where the wire properties abruptly change, e.g. where the wire becomes heavier or thicker. Since the objective of damping is to absorb completely the incoming energy, it is preferable that the damping material starts to gradually constrain the wire motion along the distance between anchor point 96 and end of support 100. Similarly, the entrained mass of damping material gradually increase from end of support 100 to anchor 96. To assure a gradual engagement of the wires with the damping material, adjustable viscosity of uncured damping material, adjustable curing speed, a combination of damping materials with different viscosities in the uncured and different cured damping parameters may be used.

When only one damping material is used, in the final assembly step with the wires in place, the support surface 102 and the wires are treated with an interfacial adhesive primer which promotes adhesion of the damping material to the frame and to the wires. Subsequently, a metered amount of curable plastic is delivered uniformly to form a layer reaching from surface 102 to wires 42. The damping material does not extend over the wires in at the point closest to the donor roller. The material first envelopes the wires and then gradually spreads filing the spacing moving the direction away from anchor 96 toward support end 100. The profile for one material is substantially the same as that illustrated in FIG. 4 for two materials. At this point the curing has progressed enough to slow further material flow, or the curing rate is increased by raising the temperature when the conveyor belt moves the wire module under an infrared lamp.

Figure 4:
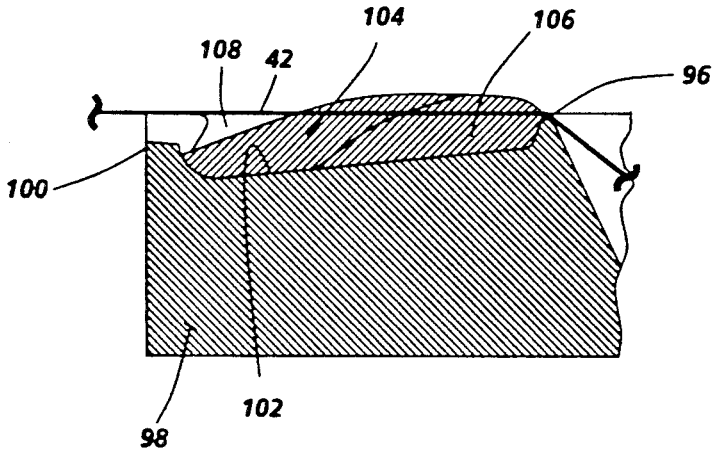
FIG. 4 is a fragmentary, sectional elevational view depicting a portion of the electrode wire mounting arrangement with damping material coated on the wire.

In FIG. 4, two damping materials are shown. The damping materials are applied sequentially to enable very slow onset of the damping along the wire. First, damping material 106, having a higher damping factor is applied. As soon as the first material is at least partially cured and stops flowing, the second damping material 104 having a lower damping factor, is applied. This results in an overcoating of damping material. Damping material 104 bridges to wire 42 in region 108. The viscosities, deposition profiles, and curing rates of the first damping material and the second damping material are carefully balanced. In this way, the materials may be poured in one after the other subsequently curing to the profile shown in FIG. 4. Alternatively, at least the first damping material may be applied as a paste by a continuous wiping motion of a doctoring blade towards anchor 96. Still another technique is to apply the damping materials and, subsequently, string the electrode wires before the damping material cures.

Figure 5:
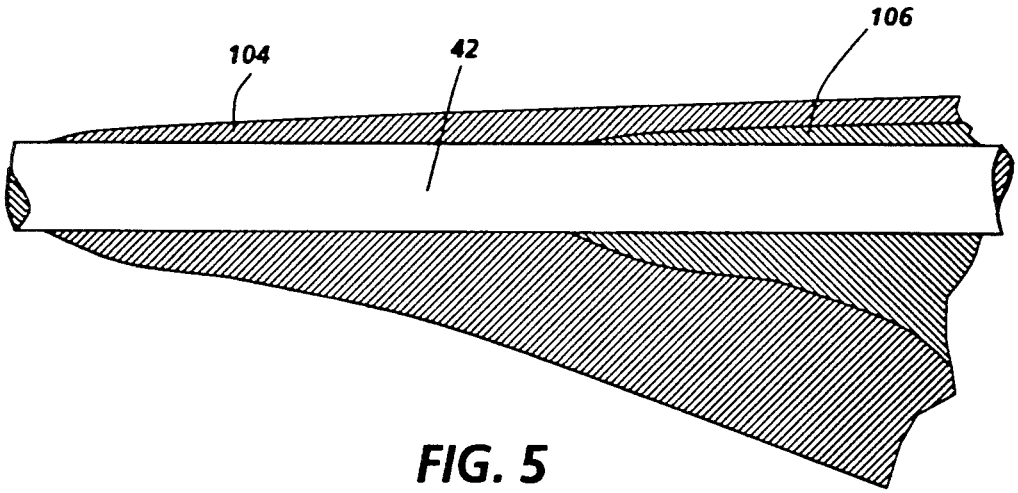
FIG. 5 is an exploded, fragmentary, sectional elevational view showing the wire with the damping material coated thereon.

Turning now to FIG. 5, there is shown an exploded view of wire 42 having damping materials 104 and 106 coated thereon. As illustrated, in the region closest to end 100 of support 98, only the softer damping material 104 coats wire 42. Progressing along wire 42 toward anchor 96, the thickness of damping material 104 gradually increase with the harder damping material 106 now being interposed between wire 42 and damping material 104. Examples of damping materials are silicone materials, such as RTV-160 (lower viscosity) or RTV-63 and RTV-700 (higher viscosity) made by General Electric. Suitable primers are SS4155, SS4004, SS4044 and SS4171 also made by General Electric. These materials have excellent insulating properties, mechanical strength and resistance to corrosive environments. The compound curing time can be controlled by the concentration of catalyst, temperature, or both. The damping factor can be further optimized by addition of fillers such as silica, metal oxides, or carbon black. The damping factor can be measured by commercially available mechanical spectrometers to guide material optimization.

In recapitulation, it is evident that the developer unit of the present invention includes electrode wires positioned closely adjacent the exterior surface of a donor roller and in the gap between the donor roller and the photoconductive member. The electrode wires having damping material coated thereon in the marginal regions thereof to damp wire vibrations and avoid strobing. An AC voltage is applied to the electrode wires to detach toner particles from the donor roller so that a toner powder cloud is formed in the gap between the photoconductive member and the donor roller. Detached toner particles from the toner powder cloud are attracted to the latent image recorded on the photoconductive member to develop the latent image.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a surface, including:

a housing defining a chamber storing at least a supply of toner therein;

a donor member spaced from the surface and being adapted to transport toner to a region opposed from the surface;

an electrode member positioned in the space between the surface and said donor member, said electrode member being closely spaced from said donor member and being electrically biased to detach toner from said donor member so as to form a toner cloud in the space between said electrode member and the surface with detached toner from the toner cloud developing the latent image; and a damping material coating at least a portion of opposed marginal regions of said electrode member to damp vibration of said electrode member.

2. An apparatus according to claim 1, further including a mounting means adapted to support opposed marginal end regions of said electrode member in the region of said damping material.

3. An apparatus according to claim 2, wherein said mounting means defines a trough adapted to be filled at least partially with said damping material coating opposed marginal regions of said electrode member.

4. An apparatus according to claim 3, wherein said damping material includes:

first layer of material coating a portion of said electrode; and a second layer of material coating a portion of said electrode and said first layer of material.

5. An apparatus according to claim 4, wherein said first layer of material is a different material from said second layer of material.

6. An apparatus according to claim 5, wherein said second layer of material is harder than said first layer of material.

7. An apparatus according to claim 6, wherein said electrode member includes a plurality of small diameter wires.

8. An electrophotographic printing machine of the type in which an electrostatic latent image recorded on a photoconductive member is developed to form a visible image thereof, wherein the improvement includes:

a housing defining a chamber storing at least a supply of toner therein;

a donor member spaced from the photoconductive member and being adapted to transport toner to a region opposed from the photoconductive member;

an electrode member positioned in the space between the photoconductive member and said donor member, said electrode member being closely spaced from said donor member and being electrically biased to detach toner from said donor member so as to form a toner cloud in the space between said electrode member and the photoconductive member with detached toner from the toner cloud developing the latent image; and a damping material coating at least a portion of opposed marginal regions of said electrode member to damp vibration of said electrode member.

9. A printing machine according to claim 8, further including a mounting means adapted to support opposed marginal end regions of said electrode member in the region of said damping material.

10. A printing machine according to claim 9, wherein said mounting means defines a trough adapted to be filled at least partially with said damping material coating opposed marginal regions of said electrode member.

11. A printing machine according to claim 10, wherein said damping material includes:

first layer of material coating a portion of said electrode; and a second layer of material coating a portion of said electrode and said first layer of material.

12. A printing machine according to claim 11, wherein said first layer of material is a different material from said second layer of material.

13. A printing machine according to claim 12, wherein said second layer of material is harder than said first layer of material.

14. A printing machine according to claim 13, wherein said electrode member includes a plurality of small diameter wires.

* * * * *